US008662743B2

(12) United States Patent
Speichinger

(10) Patent No.: US 8,662,743 B2
(45) Date of Patent: Mar. 4, 2014

(54) BRACELET ATTACHMENT DEVICE

(75) Inventor: Ferdinand Speichinger, Neuhausen am Rheinfall (CH)

(73) Assignee: Richemont International SA, Villars-sur-Glane (CH)

( * ) Notice: Subject to any disclaimer, the term of this patent is extended or adjusted under 35 U.S.C. 154(b) by 0 days.

(21) Appl. No.: 13/532,142

(22) Filed: Jun. 25, 2012

(65) Prior Publication Data

US 2013/0003510 A1 Jan. 3, 2013

(30) Foreign Application Priority Data

Jul. 1, 2011 (EP) ..... 11172442

(51) Int. Cl.
*A44C 5/00* (2006.01)
*G04B 37/00* (2006.01)

(52) U.S. Cl.
USPC ..... 368/282; 224/165

(58) Field of Classification Search
USPC ..... 224/164–180; 24/265 WS; 368/281–283
See application file for complete search history.

(56) References Cited

U.S. PATENT DOCUMENTS

| | | | | |
|---|---|---|---|---|
| 2,009,254 | A | 7/1935 | Feid | |
| 2,014,713 | A | 9/1935 | Baker | |
| 2,820,275 | A | 1/1958 | Lancaster | |
| 2,827,213 | A * | 3/1958 | Cornu | 224/174 |
| 3,581,960 | A | 6/1971 | Ojima | |
| 3,908,243 | A | 9/1975 | Lou et al. | |
| 5,090,094 | A * | 2/1992 | Bert | 24/265 WS |
| 6,408,491 | B2 | 6/2002 | Guyard | |
| 7,509,712 | B2 * | 3/2009 | Sima | 24/265 WS |
| 7,575,368 | B2 | 8/2009 | Guillaume | |
| 8,029,185 | B2 * | 10/2011 | Faucher et al. | 368/282 |
| 2001/0016971 | A1 | 8/2001 | Guyard | |
| 2003/0002394 | A1 | 1/2003 | Kinkio et al. | |
| 2003/0035347 | A1 * | 2/2003 | Yokosuka | 368/281 |
| 2006/0261106 | A1 | 11/2006 | Hiranuma et al. | |

FOREIGN PATENT DOCUMENTS

| | | |
|---|---|---|
| AT | 504872 | 9/2008 |
| CH | 486 860 | 3/1970 |
| CH | 685 464 A3 | 7/1995 |

(Continued)

OTHER PUBLICATIONS

Search Report, EP Application No. 1 172 442, Dec. 14, 2011, 4 pages.

(Continued)

*Primary Examiner* — Sean Kayes
(74) *Attorney, Agent, or Firm* — Patterson Thuente Pedersen, P.A.

(57) ABSTRACT

A device for fastening a wrist strap, in particular a watch strap, to a watch case, the device having a linking member, to which a strap end member of the wrist strap can be fastened and the case-side end of which can be fastened to a wrist strap pin attached laterally to the case. A securing element, which is biased against the case and has an interlocking projection located thereon, is arranged on the linking member such that the securing element can assume two positions, a first, secured position, in which the wrist strap pin is positioned in an indentation in the linking member and the securing element prevents the linking member or the wrist strap from becoming detached from the wrist strap pin and from the case, and a second, opened position, in which the wrist strap pin can be guided out of or into the indentation.

20 Claims, 4 Drawing Sheets

(56) References Cited

FOREIGN PATENT DOCUMENTS

| | | | |
|---|---|---|---|
| CN | 1309938 | | 8/2001 |
| EP | 0 664 093 | A1 | 7/1995 |
| EP | 1 128 237 | A1 | 8/2001 |
| EP | 1 387 227 | A1 | 2/2004 |
| EP | 1 655 643 | A1 | 5/2006 |
| EP | 1 772 072 | A1 | 4/2007 |
| EP | 1 785 784 | A2 | 5/2007 |
| EP | 1 839 515 | A1 | 10/2007 |
| EP | 1 995 651 | A2 | 11/2008 |
| EP | 2 229 836 | A1 | 9/2010 |
| FR | 2 686 713 | | 7/1993 |
| FR | 2 749 411 | | 12/1997 |
| FR | 2 766 587 | | 1/1999 |
| FR | 2 849 355 | | 7/2004 |
| FR | 2 893 153 | | 5/2007 |
| GB | 149 578 | A | 8/1920 |
| JP | 8000315 | | 1/1996 |
| JP | 2003043165 | | 2/2003 |
| JP | 3532962 | | 5/2004 |
| WO | WO 0062638 | | 10/2000 |

OTHER PUBLICATIONS

Office Action dated May 6, 2011 for U.S. Appl. No. 12/722,638, filed Mar. 12, 2010, 12 pages.

Search Report, Swiss Application No. CH00419/09, May 6, 2009, 1 page.

Search Report, EP Application No. 10156694.1, Jun. 30, 2010, 4 pages.

* cited by examiner

BRACELET ATTACHMENT DEVICE

RELATED APPLICATION

The present application claims priority to EP Application No. 11172442.3 filed Jul. 1, 2011, which is incorporated herein in its entirety by reference.

TECHNICAL FIELD

The present invention relates to a device for fastening a wrist strap, in particular a watch strap, to a case, in particular to a watch case, the device having a linking member, to which a strap end member of the wrist strap can be fastened and the case-side end of which can be fastened to a wrist strap pin attached laterally to the case, a securing element biased against the case being arranged, with an interlocking projection positioned thereon, on the linking member in such a way that the securing element can assume two positions, a first, secured position, in which the wrist strap pin is positioned in an indentation in the linking member and the securing element prevents the linking member and the wrist strap from detaching from the wrist strap pin and the case respectively by means of the cooperation of the interlocking projection with the case, and a second, opened position, in which the wrist strap pin can be guided out of or into said indentation.

BACKGROUND ART

A fastening device of the above-cited type was described by the applicant in patent application EP 2 229 836. As is presented in that document, simple attachment and detachment of wrist straps to/from a case, in particular in conjunction with watch straps is desirable or necessary in everyday life in a large number of situations. The solution presented in that document for a fastening device for an exchangeable wrist strap, in particular in the watch sector, the device being of relatively simple design and simultaneously functioning without additional tools, provided a considerable improvement with regard to these devices. Over the course of further adaptation and development of the use of the system, however, the applicant encountered difficulties which were not discernible at the start.

On the one hand, the use of the fastening device described in patent application EP 2 229 836 for exchanging a wrist strap initially requires two movements in translation, to be carried out in succession and directed in different directions, of the entire device relative to the case to which the device is to be fastened, followed by a rotational movement of the device relative to the casing. This may be found to be complicated or bothersome by unpracticed users or with infrequent actuation, and it therefore appears to be worthwhile simplifying the course of the movement and thereby changing the structure of the device forming the basis of this course of movement.

On the other hand, in the case of the above-mentioned device, a small flattened region or a notch is required laterally on the watch case, for example with use in the watch sector, as is schematically clear from the figures of patent application EP 2 229 836. This is the case in particular insofar as the shaft of the securing element used in this device is attached relatively closely to the case-side end of the fastening device. Due to the normally round shape of watch cases, the shaft therefore would stand in the way of the watch case in the central part of the device if the watch case were not provided at this point with the flattened region or a notch. In order to overcome this design limitation, no matter how slight, at the case, a fastening device which is also improved in this regard therefore is desirable.

In any case, the improved fastening device for an exchangeable wrist strap without use of tools should also satisfy the criteria with regard to aesthetics, ergonomics, wearer comfort, hygiene by way of simple cleaning of the system and, in particular, robustness and protection against accidental detachment, as is the case with the device according to patent application EP 2 229 836. It should also be possible to use the device with any type of exchangeable wrist straps, that is to say not only in relation to watches, but generally with any type of wrist strap which is mounted onto a case and has to be occasionally exchanged.

SUMMARY OF THE INVENTION

The aim of the present invention is to implement an exchangeable wrist strap of this type, in particular to implement an improved fastening device having the above-mentioned advantages. The present invention therefore relates to a wrist strap fastening device having the characterizing features mentioned in claim 1 and also to a corresponding watch strap and a corresponding watch which comprise a device of this type.

In order to achieve the aforementioned aims, the invention is characterized, in particular, in that the device comprises a blocking element which is attached pivotably to the securing element and which blocks or releases the wrist strap pin depending on the position of the securing element.

In particular, the indentation on the underside of the linking member forms a first groove which is suitable for receiving the wrist strap pin, is oriented transversely to the longitudinal axis of the wrist strap and appreciably defines in longitudinal section a first direction, while the blocking element comprises a second groove which is suitable for receiving the wrist strap pin, is oriented transversely to the longitudinal axis of the wrist strap and, in the first, secured position of the securing element, appreciably defines in longitudinal section a second direction relative to the first direction, in such a way that the wrist strap pin, in this first, secured position, is wedged between the first and second groove in such a way that the wrist strap pin is secured against detachment from the device. In addition, the blocking element is attached pivotably to the securing element by means of its own shaft, in such a way that movement of the securing element into its first, secured position automatically causes the wrist strap pin to latch into the second groove in the blocking element, while movement of the securing element into its second, opened position automatically causes the wrist strap pin to unlatch from the second groove.

The securing element, biased against the case, with the interlocking projection arranged thereon has two positions as a result of this design, similarly to the device according to patent application EP 2 229 836, the positions corresponding to a secured position of the wrist strap and an opened position for attaching or detaching the wrist strap, wherein, however, the elbowed indentation in the linking member used in that case has been replaced by the cooperation between two simple grooves formed in two parts movable relative to one another, the blocking element and the linking member. The course of movement by means of which the user of the device can change the wrist strap attached to the case is thus simplified due to this modified structure.

In addition, the securing element can be embodied for example as a pivotable lever which is spring-loaded against the case, wherein the pivot shaft of the securing element consists of two separate parts each attached to the outer ends of the linking member and securing element respectively so that a free space is created in the central region of the securing element which can be occupied by the case. With use in the watch sector, the small flattened region formed laterally at the watch case therefore is no longer required as compared to the device according to patent application EP 2 229 836, the improved device thus now providing complete design freedom in terms of the case. Alternatively, a securing element in the form of a correspondingly shaped pusher is also possible.

The further advantages, like already provided in the case of the device according to patent application EP 2 229 836, concerning the possibility of exchanging a wrist strap without the use of additional tools the possibility for use with all conventional commercial watch cases comprising a wrist strap pin, the protection against accidental detachment, and the robustness, ergonomics and wearer comfort are completely maintained in the case of the improved device.

The wrist strap fastening device according to the invention can also be used together with any desired wrist strap which is to be fastened to a case, in particular with watch straps, whatever material these may be made of. Accordingly, the system can be used in any watch having a watch case with two lugs to which a wrist strap pin is attached fixedly or in a detachable manner. However, as the field of use is not only limited to watches, but includes any type and size of wrist strap which is to be fastened to a case which, in principle, may be of any form and, for example, carries a gemstone, an image or another object, the system according to the invention can therefore be used in an overall extremely versatile manner.

BRIEF DESCRIPTION OF THE DRAWINGS

The appended figures illustrate, by way of example, two embodiments of a device for fastening a wrist strap according to the present invention.

DETAILED DESCRIPTION OF THE DRAWINGS

Figure 1A:
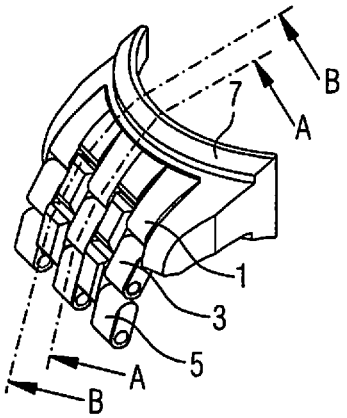
FIGS. 1*a* and 1*b* are perspective views of a first embodiment of a wrist strap fastening device according to the invention in the state assembled with the case and in the state in which the fastening device has been detached from the case, which is only illustrated in part.

Two embodiments of the invention will now be described in detail with the aid of the aforementioned figures. The wrist strap fastening device according to the invention will in this regard be presented by way of example in particular in conjunction with a watch strap which is to be fastened to a watch case in a conventional manner, in each case having two lugs on either side, although, as stated hereinbefore, a device of this type can easily be mounted onto any desired case and the following description in relation to watch straps is therefore not in any way intended to restrict the scope of application of the invention.

FIG. 1 a is a schematic and exemplary perspective view of a first embodiment of a device according to the invention for fastening a wrist strap to a case 7, in particular a watch strap to a watch case, the device being shown in the state assembled with the case. FIG. 1*b* is a perspective view of the state in which the fastening device is detached from the case 7, which is only illustrated in part. The device comprises a linking member 1, to which a strap member 5 of the wrist strap can be fastened and of which the case-side end can be fastened to a wrist strap pin 9 attached laterally onto the case 7. As is the case in the device according to patent application EP 2 229 836, the fastening device also has a securing element 2, which is coupled to the linking member 1 and is biased against said case 7, and, as a new development, a blocking element 3, wherein, in the present first embodiment, the strap member 5 is attached indirectly to the linking member 1 by being fastened to the blocking element 3. For closer illustration of the structure and arrangement of the different parts of the fastening device according to the invention, FIGS. 1*c* and 1*d* show perspective views of the same embodiment obliquely from above and obliquely from below respectively, wherein merely the wrist strap fastening device with a wrist strap end member 5 fastened thereto is illustrated and, for improved comprehension, the linking member 1 of the device is shown transparently. FIG. 1*e* also schematically shows the wrist strap fastening device in the state joined to the case in an exemplary partial plan view, wherein, in this case too, the upper parts are shown transparently so as to enable improved comprehension of the underlying parts.

Figure 1B:
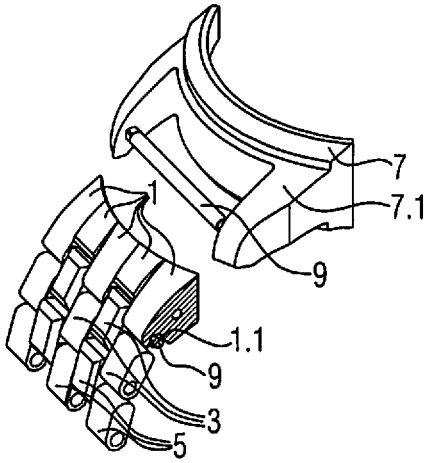
Figure 1C:
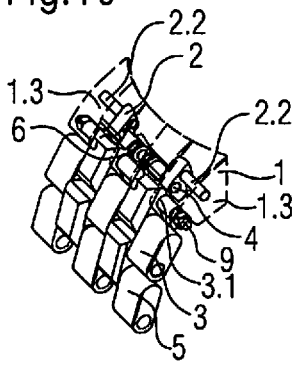
FIGS. 1*c* and 1*d* are perspective views from above and below respectively of the embodiment of FIGS. 1*a* and 1*b*, wherein only the wrist strap fastening device with a wrist strap member fastened thereto is illustrated and the linking member of the device is shown transparently for improved comprehension, in particular with regard to the blocking element.
Figure 1D:
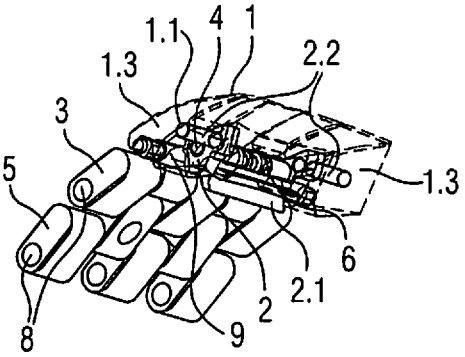
Figure 1E:
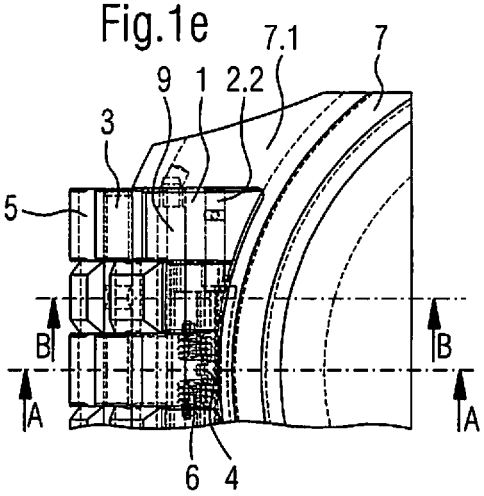
FIG. 1*e* schematically illustrates the wrist strap fastening device in the state joined to the case in an exemplary partial plan view.
Figure 1F:
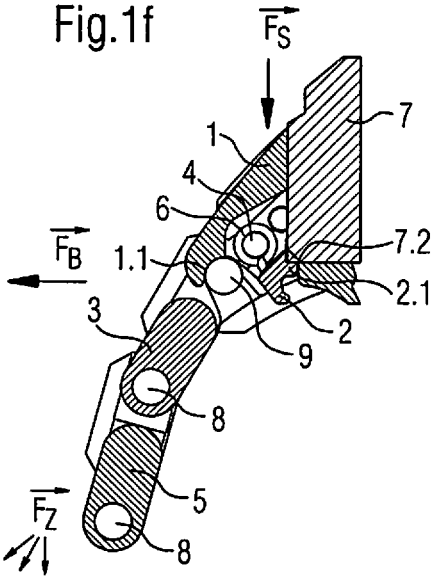
FIGS. 1*f* and 1*g* show longitudinal sections through the device according to the invention along the sectional lines A-A and B-B indicated in FIGS. 1*a* and 1*e* respectively.
Figure 1G:
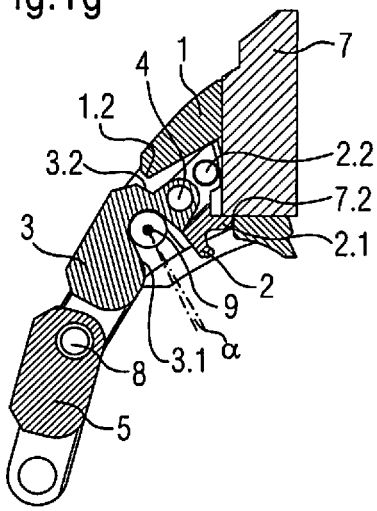

As can be seen in detail for example from FIGS. 1*f* and 1*g*, which illustrate, respectively, longitudinal sectional views along the longitudinal axis of the wrist strap and of the device according to the invention, that is to say along the lines A-A and B-B indicated in FIGS. 1*a* and 1*e* respectively, the strap end member 5 of the wrist strap can be pivotably fastened to the blocking element 3 of the device, for example in the conventional manner by means of a strap member shaft 8. The wrist strap itself (not shown in the figures) is in turn fastened to the strap end member 5, for example likewise by means of further strap member shafts 8, and can be made of metal, of leather, of rubber or of any other material suitable for this purpose, for example synthetic material such as plastic or another plastics material. In this regard, it should also be noted that the wrist strap preferably consists of a metal wrist strap in the first embodiment of the device according to the invention. For this reason, the strap end member 5 is manufactured from one piece for example, as can be seen in particular from FIG. 1*b*, and, as illustrated, the surface thereof can be designed in such a way that, visually, it appears to consist for example of five individual parts joined together so that a harmonic overall impression is given in conjunction with a metal wrist strap. The same is true in the embodiment illustrated in the figures for the blocking element 3 and the linking member 1, which in this embodiment have a surface design of this type, likewise merely for aesthetic reasons, but are integral, i.e. are made of one piece. Nevertheless, it is still possible, even in this embodiment, to use a wrist strap made of a different material and having a different surface design of these parts and to couple it to the strap end member 5. An embodiment of the present invention for a wrist strap made of leather, of rubber, or of synthetic material will be discussed in greater detail over the course of the description of the second embodiment.

The case 7 shown in figures la and lb and which can be used in all discussed embodiments consists, for example, of a normal watch case with two laterally attached lugs 7.1 to which a wrist strap pin 9 is attached fixedly or in a detachable manner, for example in the form of a spring pin known to a person skilled in the art. However, as mentioned hereinbefore, the case does not necessarily have to consist of a watch case, but can serve any other purpose, provided it is equipped with a part corresponding to the wrist strap pin 9.

The core of the present invention lies in the configuration of the side of the device for fastening a wrist strap according to the invention that faces the spring pin 9 of the case 7 and will be described hereinafter in greater detail.

On the one hand, the linking member 1 of the device comprises an indentation 1.1 for this purpose on its underside, that is to say on its side facing towards the spring pin 9 and the base of the case 7, as is shown in particular in the perspective views 1*b*, 1*c* and 1*d* and in FIG. 1*f*, which is presented as a longitudinal section with partial side view. The indentation 1.1 can form a first groove 1.1 suitable for receiving the wrist strap pin 9, as can be seen from FIG. 1*b* for example. This first groove 1.1 is oriented in a plane parallel to the plane of the wrist strap, transverse to the longitudinal axis of the wrist strap and appreciably defines in longitudinal section a first direction. The groove 1.1 corresponds appreciably in terms of width to the diameter of the spring pin 9 and, for example, may preferably correspond to between half the diameter of the spring pin 9 and the entire diameter of the spring pin 9, and is used as a type of support surface or retaining groove for the spring pin 9, as will be clarified further below.

As can be seen from FIG. 1*d*, in particular, the linking member 1 of the device according to the invention is preferably embodied so as to be appreciably U-shaped in cross-section, the shaping of the central part of the linking member 1 being appreciably adapted to the shape of the case 7 between the lugs 7.1, while the lateral arms or jaws 1.3 of the linking member 1 nestle against the inner side faces of the lugs 7.1. These lateral arms 1.3 of the linking member 1 are embodied on the underside thereof and therefore face the wrist strap pin 9 of the case 7, so that the indentation 1.1 is shaped with the groove 1.1, which is oriented transversely to the longitudinal axis of the wrist strap, in these two arms 1.3. Furthermore, a hollow space, which is ideally suited to receiving the securing element 2, is formed between these two arms 1.3. With regard to the configuration of the linking member 1, it should be noted with reference to FIGS. 1*a* and 1*b* that the linking member 1 according to embodiments of the present invention or the surface thereof generally has an upper side, the shape of which is complementary to that of the case 7, so that the linking member 1 and the case 7 form a substantially unitary, continuous surface. This allows the wrist strap fastening system according to the invention to be designed in an extremely advantageous manner in terms of aesthetics and ergonomics. In particular in the case of a watch strap, in spite of use of a wrist strap pin 9, the terminal surface of the device can be selected to be completely complementary to that of the case 7, without an open slit being visible in the case of round case shapes.

On the other hand, as can be seen from FIG. 1*c*, 1*d* or 1*f* for example, the device comprises the securing element 2 coupled to the linking member 1 and biased against the case 7, wherein the securing element is mounted pivotably on the linking member 1, for example by means of a shaft 2.2 attached parallel to said groove 1.1.

In the embodiments illustrated in the figures, the securing element 2 is formed as a pivotable lever which is spring-loaded against the case 7. In particular and in contrast to the device according to patent application EP 2 229 836, the pivot shaft 2.2 of the securing element 2 consists of two separate parts each attached to the outer ends of the linking member 1 and securing element 2 respectively, as can be seen from perspective views 1*c* and 1*d*. The two separate shaft parts 2.2 can be anchored in the two above-mentioned lateral arms 1.3 of the linking member 1 or mounted so as to be freely rotatable, as is indicated schematically in FIG. 1*c* for example. As a result of this structure, a free space is created in the central region of the securing element 2 and can be occupied by the case 7. As illustrated in FIG. 1*b* for example, the freedom of design when selecting the case 7 is therefore greater, above all in the case of round case shapes, and therefore a flattened region arranged laterally on the case 7 is no longer necessary.

Furthermore and as is already the case with the device according to patent application EP 2 229 836, the securing element 2 further has an interlocking projection 2.1 which is oriented in the direction of the case 7. The securing element 2 is arranged on the linking member 1 in such a way that it can assume two positions. These two positions correspond to a first, secured position, in which the wrist strap pin 9 is positioned in the groove 1.1 in the linking member 1 and the securing element 2 prevents the linking member 1 and the wrist strap from detaching from the wrist strap pin 9 and from the case 7 respectively by means of the cooperation of the interlocking projection 2.1 with the case 7, see FIG. 1*f*, and a second, opened position, in which the wrist strap pin 9 can be guided out of or into the groove 1.1.

It is also possible to further specify with the aid of FIGS. 1*f* and 1*g* that the interlocking projection 2.1 of the securing element 2 of a device according to embodiments is arranged in the direction and at the level of the lower edge 7.2 of the case 7. As a result, in the first, secured position of the securing element 2, the interlocking projection 2.1 reaches below the edge 7.2 of the case 7 and thus prevents the linking member 1 from in any way moving in a manner which is directed toward the upper side of the case and might cause the linking member 1 to become detached from the wrist strap pin 9. In the second, opened position of the securing element 2, the interlocking projection 2.1 releases the lower edge 7.2 of the case and thus allows a movement, which will be described more precisely hereinafter, for detaching the linking member 1 from the wrist strap pin 9 or for attaching the linking member to this pin. As a result of this configuration of the securing element 2 and of the interlocking projection 2.1 located thereon, the force $F_s$, exerted by the securing element 2 on the case 7 for securing and interlocking the linking member 1 on the wrist strap pin 9 or the wrist strap on the case 7 is oriented appreciably at right angles to the plane of the case 7, whereas the tensile and torsional forces $F_z$ exerted on the wrist strap pin when the wrist strap is worn are oriented as a function of the respective size of the wrist of the person wearing the watch, roughly in the longitudinal direction of the wrist strap. These forces are directed against various parts of the case, namely, on the one hand, against the lower edge 7.2 of the case and also, on the other hand, against the wrist strap pin 9. Furthermore, the force $F_B$ for actuating the securing lever, allowing the linking member 1 to be detached from the wrist strap pin 9 and allowing the wrist strap to be detached from the case 7, is oriented substantially perpendicularly to the direction of the aforementioned interlocking force $F_s$, and possibly also of the tensile forces $F_Z$. The orientation of the forces which occur is indicated symbolically by means of arrows in FIG. 1*f*. This has the advantage that it will normally not be possible for the securing lever 2 to be opened accidentally. In addition, when the wrist strap is worn, the appreciably higher tensile forces are absorbed as normal by the wrist strap pin 9 and are not transmitted to the securing element 2, which itself absorbs only the much lower interlocking force $F_S$.

In addition, the aforementioned blocking lever 3 is arranged at least partially in the above-mentioned hollow space between the two lateral arms 1.3 of the linking member 1, as can be seen from FIG. 1*g* for example, and constitutes an essential feature of the present invention. The blocking lever 3 is attached pivotably to the securing element 2 by means of a shaft 4 mounted parallel to the shaft 2.2 and blocks or releases the wrist strap pin 9 depending on the position of the securing element 2.

To this end, the blocking element 3 comprises a second groove 3.1 which is suitable for receiving the wrist strap pin 9, is oriented transversely to the longitudinal axis of the wrist strap and, in the first, secured position of the securing element 2, appreciably defines in longitudinal section a second direction relative to said first direction defined by the first groove 1.1 in the linking member 1, in such a way that the wrist strap pin 9, in this first, secured position, is wedged between the first 1.1 and second groove 3.1 in such a way that the wrist strap pin 9 and wrist strap are secured against detachment from the device and from the case 7 respectively. In other words, the elbowed indentation in the linking member of the device according to patent application EP 2 229 836 is replaced by the cooperation between two simple grooves which are located in two parts moveably relative to one another, namely the blocking element and the linking member. As will be explained in greater detail further below, the course of the movement by means of which the user of the device can change the wrist strap attached to the case is simplified by this modified structure and thus leads to an improvement of the system.

So as to enable this course of movement, the blocking element 3 is pivotably attached on the securing element 2 by means of a separate shaft 4 mounted parallel to the shaft 2.2, see FIG. 1 g for example, in such a way that a movement of the securing element 2 into its first, secured position causes the second groove 3.1 in the blocking element 3 to latch into the wrist strap pin 9. On the other hand, a movement of the securing element 2 into its second, opened position causes the wrist strap pin 9 to unlatch from the second groove 3.1. To this end, the angle a between said first and second direction defined by the first 1.1 and second groove 3.1 is selected between 0° and 60°, considered in the first, secured position of the securing element 2, preferably as an acute angle less than 30°, more preferably as an angle between 10° and 25°, so as to achieve a kind of wedging which prevents accidental detachment of the wrist strap pin 9 from the device.

Should the securing lever 2 therefore be contacted accidentally in exceptional circumstances, the linking member 1 generally will not detach from the wrist strap pin 9, insofar as the latter is wedged between the two grooves 1.1 and 3.1 due to the cooperation of the first groove 1.1 on the linking member 1, and the second groove 3.1 on the blocking lever 3 as well as the specific design and spatial arrangement thereof. This has also been tested in particular by laboratory tests and wearer trials of a watch equipped with a wrist strap according to embodiments of the invention.

Furthermore, the specific shape of the blocking element 3 can be seen from FIG. 1*g*, which makes it possible for the element 3 to have at least one extension reaching into the hollow space below the linking member, the extension cooperating with the shaft 4 on the securing element 2. It can also be seen from FIGS. 1*c* and 1*f* that spring loading in the form of at least one resilient element 6 arranged between these elements 2, 3, in particular in the form of at least one spiral spring provided on the shaft 4, is applied between the blocking element 3 and the securing element 2. This is used to define a preferred relative position between the elements 2, 3 and can also be used simultaneously to subject the securing element 2 to spring loading in the direction of the case 7.

The blocking element 3 and the linking member 1 still have a specifically selected limiting surface 3.2, 1.2 at their respective end facing the other part, these surfaces being visible in FIG. 1*g* for example. Due to their cooperation, the rotation of these two parts relative to one another can be restricted in the direction of an opening of the wrist strap, which is important inter alia so as to ensure the above-mentioned spring loading of the securing element 2 in the direction of the case 7 and the relative position between the elements 2, 3.

The mode of operation of detaching and attaching a wrist strap equipped with the device according to embodiments of the invention to a case without tools will now be described by means of FIGS. 2*a* to 2*g*, which show longitudinal sections of the device in different positions and along the line A-A in each case, similarly to that of FIG. 1*f*. As is illustrated schematically and by way of example in FIG. 2*a*, for attaching the device according to the invention to a case 7, the linking member 1 is firstly brought up to the case 7 from above in the direction of the wrist strap pin 9 by means of a movement in translation. At the end of this movement in translation, the spring pin 9 of the case 7 comes to lie in the indentation 1.1 in the linking member 1, see FIG. 2*b*. During this movement, the securing element 2 is deflected out of its rest position and counter to its spring loading as a result of the interlocking projection 2.1 striking the side wall of the case 7. A subsequent rotation of the linking member 1 or of the wrist strap fastened thereto, as is indicated symbolically by means of arrows in FIG. 2*c*, causes the upper face of the linking member 1 to approach the upper edge of the side wall of the case 7 until both touch flushly, and also causes the securing element 2 to automatically resume its secured, rest position provided that the interlocking projection 2.1 can reach below the lower edge 7.2 of the case 7 at this moment. In this position of the securing element 2 illustrated in FIG. 2*d*, the linking member 1 and the wrist strap fastened thereto are protected against detachment, that is to say in particular against accidental detachment of the wrist strap from the case 7, since the securing element 2 impedes by means of the interlocking projection 2.1 a movement of the linking member 1 in the vertical direction upward that is required for detaching the linking member 1 from the wrist strap pin 9 and a corresponding rotation. In addition, as explained above, the blocking element 3 coupled to the securing element 2 is moved in the direction of the wrist strap pin 9 by the movement of the securing element 2 below the lower edge 7.2 of the case, whereby the second groove 3.1 in the blocking element 3 latches into the wrist strap pin 9 and additionally secures it against accidental detachment.

Figure 2A:
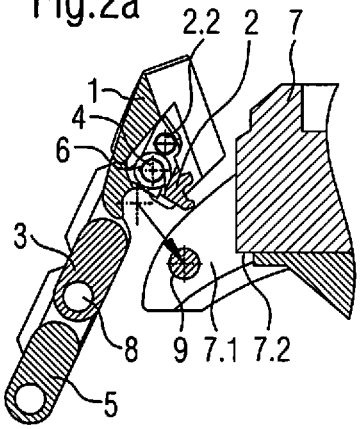
FIGS. 2*a*, 2*b*, 2*c* and 2*d* schematically illustrate the principle of the course of movement during the tool-free attachment of a wrist strap fastening device according to the invention to a case, FIGS. 2*e*, 2*f* and 2*g* schematically show the course of movement during the detachment of the device from the case.
Figure 2B:
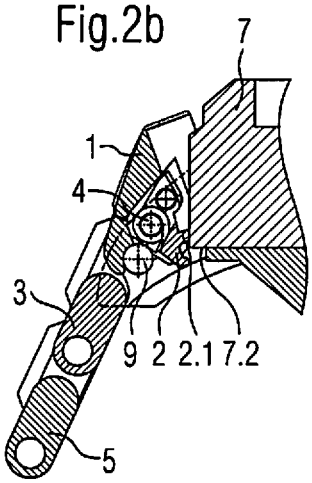
Figure 2C:
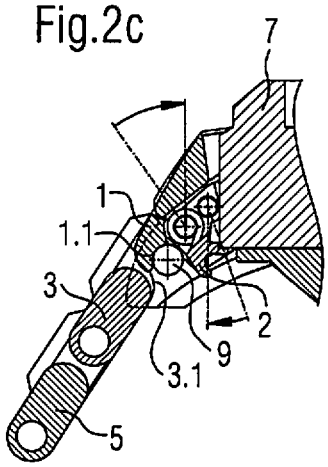
Figure 2D:
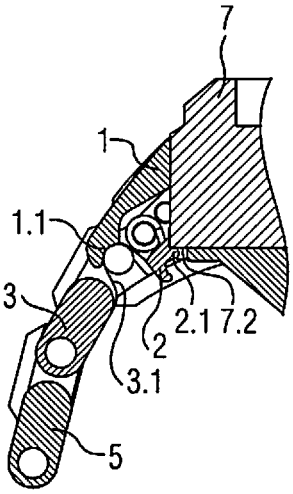
Figure 2E:
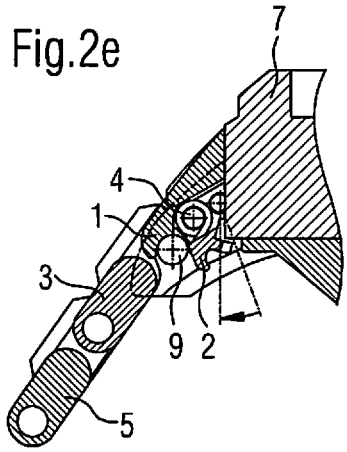
Figure 2F:
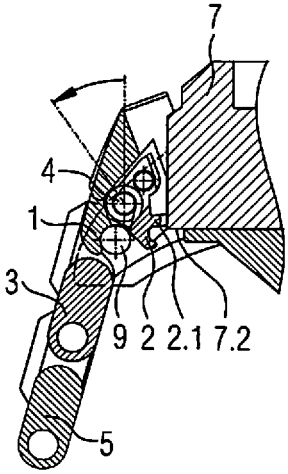
Figure 2G:
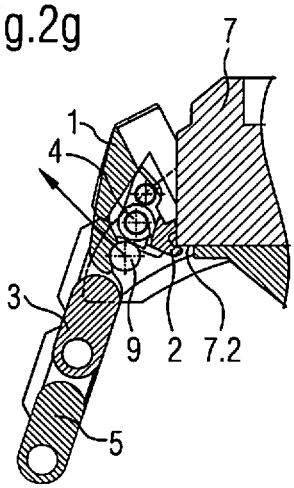

It is clear from the above that the linking member 1 is detached from the wrist strap pin 9 and a wrist strap fastened to the linking member 1 is detached from the case 7 by pressing on the securing element 2 by hand, as illustrated schematically in FIGS. 2*e*, 2*f* and 2*g*. As a result of this, the interlocking projection 2.1 firstly releases the lower edge 7.2 of the case and, at the same time, the second groove 3.1 in the blocking element 3 releases the wrist strap pin 9, see FIG. 2*e*. The subsequent slight rotation of the linking member 1 and of the wrist strap fastened thereto, as indicated symbolically by an arrow in FIG. 2*f*, is thus enabled, which again guides the upper face of the linking member 1 away from the upper edge of the side wall of the case 7. The linking member 1 and the wrist strap fastened thereto can then ultimately be detached from the wrist strap pin 9 and from the case 7 respectively by a movement in translation in the direction opposite that of the first movement in translation, as indicated symbolically by an arrow in FIG. 2*g*.

Compared to the device according to patent application EP 2 229 836, which first requires two movements in translation oriented approximately at right angles to one another and then rotation of the device in order to attach the wrist strap, the device according to the invention allows a simplified course of movement due to its modified structure, by means of which the user of the device can change the wrist strap attached to the case, namely merely one movement in translation followed by a rotation of the device. The system therefore can also be used more intuitively by unpracticed users.

A second embodiment of a wrist strap fastening device according to the invention which can be used preferably, but not exclusively, for a wrist strap made of leather, of rubber, or of synthetic material, will be explained in greater detail hereinafter with the aid of FIGS. 3*a* to 3*d*. The main difference of the second embodiment illustrated in these figures compared to the first embodiment illustrated in FIGS. 1*a* to 1*g* lies in the fact that the strap end member or the wrist strap 5 is attached directly to the linking member 1 in the second embodiment, while, in the first embodiment, the strap end member 5 is mounted indirectly on the linking member 1 by being fastened to the blocking element 3.

Figure 3A:
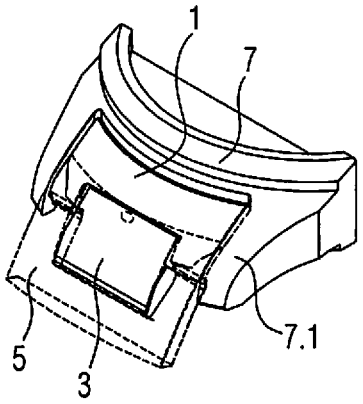
FIG. 3*a* shows a perspective view of a second embodiment of a wrist strap fastening device according to the invention, the wrist strap fastening device being in the state assembled with the case, wherein, for improved comprehension, in particular with regard to the blocking element used in this instance, the wrist strap illustrated merely partially is shown transparently.

As can be seen for example from the perspective view of the second embodiment of a wrist strap fastening device according to the invention in the state assembled with the case and illustrated in FIG. 3*a*, the strap end member or the wrist strap 5 can be fastened for example to the upper side of the linking member 1 in this second embodiment. This can be achieved for example by pinching, gluing, riveting, screwing, casting or other methods known to a person skilled in the art and will not be explained here in greater detail. In any case, in this embodiment it is preferably the surface of the wrist strap itself, and not the surface of the linking member 1, as is preferably the case in the first embodiment, which terminates flushly with the upper edge of the case 7 and forms a continuous, aesthetically seemingly unitary surface therewith, thus constituting a further key advantage of the device according to embodiments of the invention and providing an interesting option for the design of wrist straps.

Figure 3B:
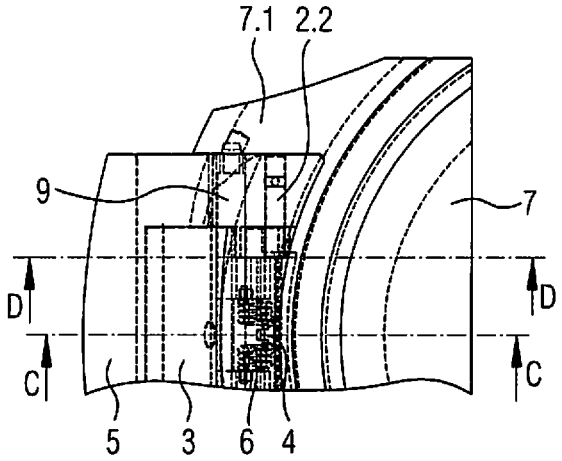
FIG. 3*b* schematically and exemplary shows the second embodiment of the wrist strap fastening device in the state joined to the case in a partial plan view, likewise with the wrist strap illustrated merely partially and some underlying parts being illustrated transparently for improved comprehension.
Figure 3C:
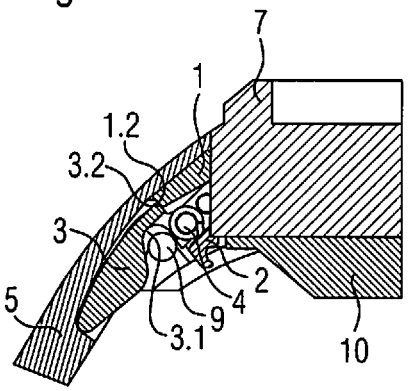
FIGS. 3*c* and 3*d* are longitudinal sectional views, similar to FIGS. 1*f* and 1*g*, through the second embodiment of a device according to the invention along the lines C-C and D-D respectively illustrated in FIG. 3*b;*
Figure 3D:
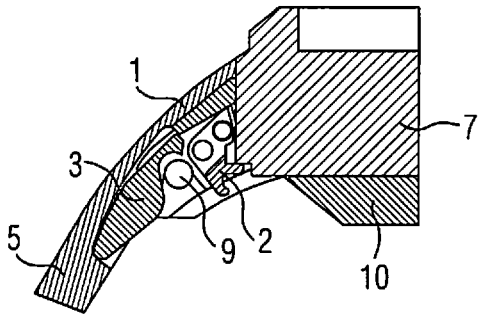
Figure 3E:
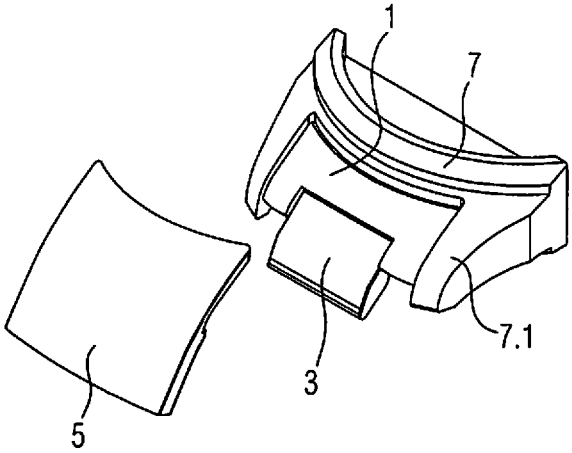
FIGS. 3*e*, 3*f* and 3*g* show perspective views, similar to FIG. 3*a*, of the wrist strap fastening device, still not assembled with the case and in the assembled state, in each case not transparently, and transparently when assembled with the entire device.
Figure 3F:
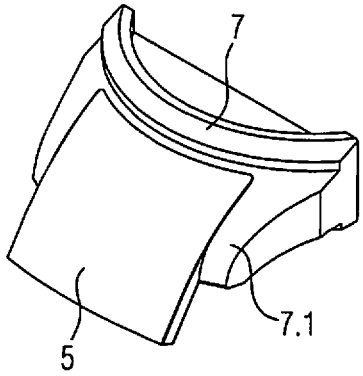
Figure 3G:
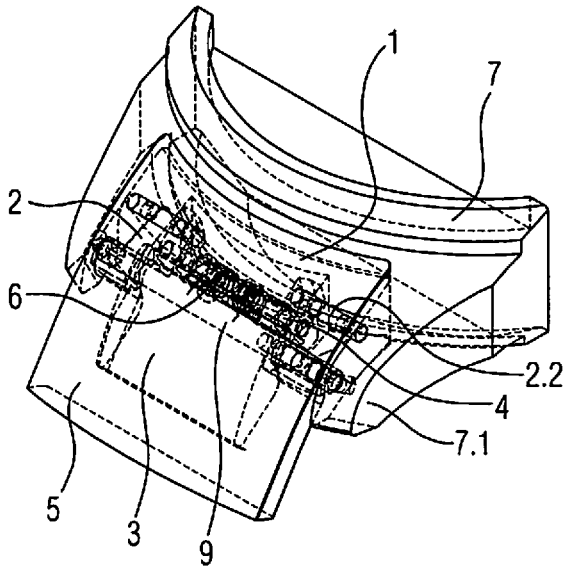

It can also be seen from FIG. 3*a* and from FIG. 3*b*, which schematically show exemplary partial plan views of the second embodiment of the wrist strap fastening device in the state joined to the case, the wrist strap only being illustrated in part and the views being shown transparently for improved comprehension and so as to show some of the underlying parts, that in this embodiment the blocking element 3 can be formed simply, that is to say in particular with a more homogeneous form in longitudinal section. This can be easily understood insofar as the blocking element 3 is not used in this embodiment simultaneously as a connecting member between the linking member 1 and the strap end member 5, but is used merely for the purpose of providing additional blocking and securing of the wrist strap pin 9. This can also be seen clearly from FIGS. 3*c* and 3*d*, which illustrate longitudinal sections similar to FIGS. 1*f* and 1*g* through the second embodiment of a device according to the invention along the lines C-C and D-D respectively as indicated in FIG. 3*b*. The respective limiting surfaces 3.2, 1.2 attached at their end facing the other part are also visible, inter alia, in these figures on the blocking element 3 and on the linking member 1 as well as the grooves 1.1, 3.1. The shafts 2.2 of the securing element 2 and 4 of the blocking element 3 and the wrist strap pin 9 can also be seen in the transparent illustration of FIG. 3*b*, wherein the arrangement of all of these features may follow that of the first embodiment. For the rest, this second embodiment is structured similarly to the first embodiment of the device according to the invention, and its operation is completely similar to that described above, neither of these points therefore requiring further explanation.

In the two embodiments detailed above of a wrist strap fastening device according to the invention, the securing element 2 is formed as a pivotable lever which is spring-loaded against the case 7. Pressing by hand on the interlocking projection 2.1, which protrudes slightly from the underside of the linking member 1 and, in the assembled state, also from the underside of the base 10 of the case 7, allows this securing element 2 to be brought from its first, secured rest position, counter to the spring-loading force, into its second, opened position by means of rotation, allowing attachment or detachment of the linking member 1 or of the wrist strap to/from the wrist strap pin 9 or the case 7 respectively. However, the above-described function of the element 2 securing the opening and interlocking operations can also be implemented mechanically in another way, in particular in the form of a pusher, that is to say by means of a movement in translation instead of rotation.

Such an alternative solution will be explained briefly hereinafter, without being illustrated explicitly in the figures. In this alternative solution, the securing element 2 can be formed for example as a displaceable pusher which is spring-loaded against the case 7, while the other parts are arranged as described above. Such a pusher is preferably formed on the case side in such a way that a free space is likewise created in the central region of the securing element 2 and can be occupied by the case 7 so as to also ensure the freedom of design of the shape of the case in this variant too. In this case, the pusher attached displaceably in the hollow space in the linking member 1 would be able to be displaced towards and away from the case, guided by means of corresponding guiding ribs in the side arms 1.3 of the linking member 1, instead of being pivoted, wherein a corresponding compression spring would first load the pusher in the direction of the case 7 and a secured position would be provided by specific shaping of the guiding ribs for example. Similarly to the aforementioned pivotable lever, the securing element 2 consisting of the displaceable pusher and of the associated compression spring could also be replaced by a corresponding one-part resilient element.

Furthermore, it should also be added that the wrist strap pin 9 can play a key role for the desired cooperation between a wrist strap fastening device according to embodiments of the invention and the case, to which the device or the wrist strap is to be fastened. This is the case in particular with regard to the requirements of robustness and safety of the wrist strap pin fastened to the case, since, depending on intensity and direction, the effects of forces acting on the wrist strap fastening device are transferred from the device onto the wrist strap pin 9. The structure, geometry and function of the fixed or removable wrist strap pin 9 should therefore be adapted accordingly, for example so as to prevent unintended detachment of said wrist strap fastening device from the case.

Figure 4A:
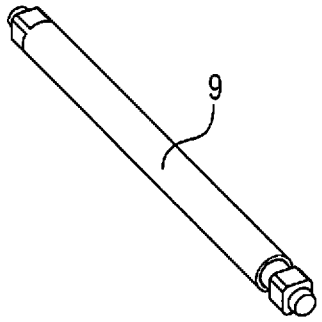
FIGS. 4*a*, 4*b* and 4*c*, respectively, show a perspective view, side view and a longitudinal sectional view along the line E-E indicated in FIG. 4*b* of a wrist strap pin which can be screwed in and used with the wrist strap fastening device according to the invention.
Figure 4B:
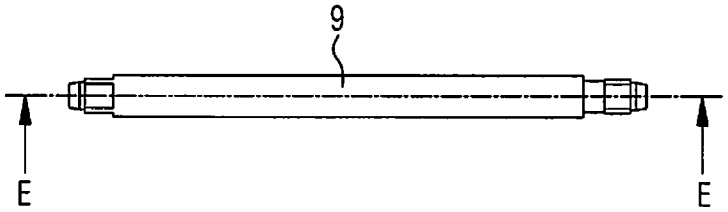
Figure 4C:
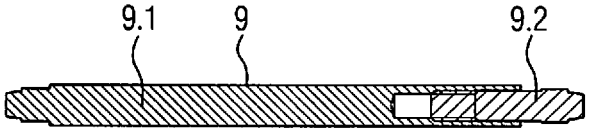

According to the wearer trials carried out by the applicant, in the conventional embodiment of a spring pin known to a person skilled in the art and consisting of two telescopic tubes which are slid freely in one another and are equipped with spring elements, a wrist strap pin 9 loaded by spring force and mounted between the lugs 7.1 of the case 7 can resiliently yield more greatly to the effects of external forces under specific circumstances compared to that which would be desirable for reliable cooperation between a wrist strap fastening device according to the invention and the case. A watch pin 9 fixed between the case lugs 7.1 and designed and constructed accordingly in terms of dimensioning, thickness and resilience therefore can also preferably be used for the wrist strap fastening device according to the invention and may consist in particular of two tubes 9.1, 9.2 which are screwed into one another without play by fine threads, as is clear from FIGS. 4*a*, 4*b* and 4*c*. Depending on the intended use of the wrist strap fastening device, either a conventional telescopic spring pin known to a person skilled in the art or a wrist strap pin which is screwed, as proposed above, that is to say which is likewise removable but has increased rigidity, can preferably be used together with the wrist strap fastening device. Where necessary and in conjunction with the wrist strap fastening device according to embodiments of the invention, the wrist strap pin may be used without difficulty as a replacement for a conventional spring pin in any watch which has a watch case 7 having two lugs 7.1 on each side.

The device according to embodiments of the invention therefore allows extremely simple handling and elegantly implements a system for detaching and attaching a wrist strap from/to a case, in particular a watch strap from/to a watch case, without tools.

It will also be clear from the foregoing that the present invention also relates, in particular, to a watch strap having a device according to the invention for fastening a wrist strap and also to a watch having a corresponding wrist strap.

In addition, the foregoing, detailed description of the wrist strap fastening device according to embodiments of the invention makes it clear that the present invention allows in an optimum manner a wrist strap to be enabled to be exchanged without tools by way of simply designed constructional features which are positioned only on the watch strap side, without the need for alterations on the case side. The system according to the invention therefore has the advantage, in particular, of being able to be used with all conventional commercial cases, above all watch cases, having a wrist strap pin. The comparatively simple design, which is based on a specifically shaped indentation in combination with a corresponding securing element and a blocking element, makes the device and a corresponding wrist strap relatively simple and inexpensive to produce. Furthermore, as a result of the fact that the tensile and interlocking forces which occur are oriented toward various parts of the case and substantially perpendicularly to the direction of the force for actuating the securing lever, the device according to the invention satisfies in an exemplary manner the criteria to be applied on safety and robustness of a system of this type. Insofar as there is broad latitude for configuring the shape and the composition of the device according to the invention, particularly of the surface of the linking member and of the wrist strap, the aesthetics, the ergonomics and the wearer comfort of a wrist strap equipped with a fastening device according to the invention may be said to be further advantages of the present invention. Lastly, a device according to the invention can be used easily and intuitively by the user when a wrist strap is changed.

The invention claimed is:

1. A device for fastening a wrist strap to a case, the device comprising a linking member, to which a strap end member of the wrist strap can be fastened and a case-side end of which can be fastened to a wrist strap pin attached laterally to said case, a securing element, which is biased against a case and has an interlocking projection located thereon, being arranged on the linking member in such a way that the securing element can assume two positions, a first, secured position, in which the wrist strap pin is positioned in an indentation in the linking member and the securing element prevents the linking member and the wrist strap from becoming detached from the wrist strap pin and from the case respectively by means of the cooperation of said interlocking projection with the case, and a second, opened position in which the wrist strap pin can be guided out of or into said indentation, wherein the device has a blocking element which is attached pivotably to said securing element and which blocks or releases the wrist strap pin depending on the position of the securing element.

2. The device as claimed in claim 1, wherein said indentation on the underside of the linking member forms a first groove which is suitable for receiving the wrist strap pin, is oriented transversely to a longitudinal axis of the wrist strap, and appreciably defines in longitudinal section a first direction, while the blocking element comprises a second groove which is suitable for receiving the wrist strap pin, is oriented transversely to the longitudinal axis of the wrist strap and, in the first, secured position of the securing element, appreciably defines in longitudinal section a second direction relative to said first direction, in such a way that the wrist strap pin, in this first, secured position is wedged between the first and second groove in such a way that the wrist strap pin is secured against detachment from the device.

3. The device as claimed in claim 2, wherein the angle ($\alpha$) between said first and said second direction is between 1° and 30° in the first, secured position of the securing element.

4. The device as claimed in claim 2, wherein the angle ($\alpha$) between said first and said second direction is between 10° and 25° in the first, secured position of the securing element.

5. The device as claimed in claim 2, wherein the angle ($\alpha$) between said first and said second direction is between 0° and 60° in the first, secured position of the securing element.

6. The device as claimed in claim 2, wherein the blocking element is attached pivotably to said securing element by means of a separate shaft in such a way that movement of the securing element into its first, secured position causes the wrist strap pin to latch into said second groove in the blocking element, whilst movement of the securing element into its second, opened position causes the wrist strap pin to unlatch from said second groove.

7. The device as claimed in claim 1, wherein spring loading in the form of at least one resilient element in the form of at least one spiral spring, arranged between the blocking element and the securing element is provided between said elements to define a preferred relative position, whereby the securing element is also spring-loaded in the direction of the case.

8. The device as claimed in claim 1, wherein the blocking element and the linking member each have a limiting surface at their respective ends, the limiting surfaces of the blocking element and the linking member facing one another such that cooperation of said limiting surfaces restricts the rotation of the blocking element and the linking member relative to one another in the direction of an opening in the wrist strap.

9. The device as claimed in claim 1, wherein the strap end member is attached indirectly to the linking member by being fastened to the blocking element.

10. The device as claimed in claim 1, wherein the strap end member is attached directly to the linking member.

11. The device as claimed in claim 1, wherein said securing element is embodied as a pivotable lever which is spring-loaded against the case, the pivot shaft of the securing element consisting of two parts each attached to the outer ends of the linking member and securing element respectively in such a way that a free space is created in the central region of the securing element which can be occupied by the case.

12. The device as claimed in claim 1, wherein said securing element is formed as a displaceable pusher which is spring-loaded against the case, the pusher being formed on the case side in such a way that a free space is created in the central region of the securing element which can be occupied by the case.

13. The device as claimed in claim 1, wherein said interlocking projection of the securing element is embodied as a projection arranged in the direction and at a level of a lower edge of the case in such a way that, in the first, secured position of the securing element, the projection reaches below the lower edge of the case and prevents the linking member from moving, in a manner directed toward an upper side of the case, for detaching the linking member from the wrist strap pin and that, in the second, opened position of the securing element, the projection releases the lower edge of the case and said movement for detaching the linking member is possible.

14. The device as claimed in claim 1, wherein a force ($F_s$), exerted by the interlocking projection of the securing element on the case, for interlocking the linking member on the wrist strap pin and the wrist strap on the case and also tensile and torsional forces ($F_z$) exerted on the wrist strap pin when the wrist strap is worn are directed appreciably at a right angle to the force ($F_B$) necessary for actuating the securing lever.

15. The device as claimed in claim 1, wherein said linking member is appreciably U-shaped in cross-section, said indentation, which forms a groove oriented transversely to a longitudinal axis of the wrist strap, is formed at least in two arms formed on an underside of the linking member and said securing element is arranged in a hollow space disposed between the two arms.

16. A watch strap comprising a device as claimed in claim 1.

17. The watch strap as claimed in claim 16, wherein the wrist strap fastened to the device is made of a material selected from the group consisting of metal, leather, rubber, plastic or synthetic materials.

18. A watch having a watch case, wherein the watch has a watch strap as claimed in claim 16.

19. A wrist strap pin receivable by opposed lugs of the case of a watch which is suitable for use with the watch of claim 18, wherein the wrist strap pin consists of two parts of increased rigidity, one part which can be screwed into the other part and which can be attached in a detachable manner to the opposed lugs of the case of the watch.

20. A wrist strap pin receivable by opposed lugs of the case of a watch which is suitable for use with the watch strap of claim 16, wherein the wrist strap pin consists of two parts of increased rigidity which can be screwed into one another and which can be attached in a detachable manner to the opposed lugs of the case of the watch.

* * * * *